US007076826B2

(12) United States Patent
Hochanadel

(10) Patent No.: US 7,076,826 B2
(45) Date of Patent: Jul. 18, 2006

(54) DETACHABLE FLUID TREATMENT APPLICATOR

(76) Inventor: Richard Wade Hochanadel, 13207 W. 137th Ter., Overland Park, KS (US) 66221-4119

( * ) Notice: Subject to any disclaimer, the term of this patent is extended or adjusted under 35 U.S.C. 154(b) by 47 days.

(21) Appl. No.: 10/737,407

(22) Filed: Dec. 16, 2003

(65) Prior Publication Data

US 2004/0158950 A1 Aug. 19, 2004

Related U.S. Application Data

(60) Provisional application No. 60/433,639, filed on Dec. 16, 2002.

(51) Int. Cl.
*B05C 17/00* (2006.01)
*A47L 13/10* (2006.01)

(52) U.S. Cl. ..... 15/209.1; 15/143.1; 15/144.1; 15/210.1; 15/244.1

(58) Field of Classification Search ..... 15/143.1, 15/144.1, 145, 209.1, 210.1, 244.1
See application file for complete search history.

(56) References Cited

U.S. PATENT DOCUMENTS 2,261,058 A * 10/1941 Forbis ..... 604/1
2,679,064 A 5/1954 Palma, Jr. et al.
2,938,223 A 5/1960 Horowitz
3,094,729 A * 6/1963 Dalton ..... 15/207.2
3,562,838 A 2/1971 Burton et al.
3,720,976 A 3/1973 Bailey
3,753,267 A 8/1973 Johnson, Sr.
3,797,062 A 3/1974 LoCicero et al.
3,820,187 A 6/1974 Numbers et al.
3,947,915 A 4/1976 Kroll
4,155,139 A 5/1979 Corcoran
4,155,140 A 5/1979 Janssen et al.
4,471,507 A 9/1984 Schwartz
4,934,011 A 6/1990 Haug
5,003,659 A 4/1991 Paepke
5,341,538 A 8/1994 Banome
6,049,934 A * 4/2000 Discko ..... 15/106
6,634,051 B1 * 10/2003 Dragan et al. ..... 15/106
6,754,930 B1 * 6/2004 Tsaur ..... 15/118

* cited by examiner

*Primary Examiner*—Mark Spisich
(74) *Attorney, Agent, or Firm*—Erickson & Kleypas, L.L.C.

(57) ABSTRACT

An applicator for applying fluid treatments such as paint, stain, varnish or the like to surfaces such as wood. The applicator includes an elongated handle, one end of the hand serving as a primary gripping element, the other end of the handle being covered with fluid-retaining material such as natural or synthetic wool fleece or foam rubber to form an applicator pad. The portion of the handle bearing the applicator pad may be detached from the portion of the handle forming the primary gripping element. A secondary gripping element such as a knob is movable from a first position on the handle to a second position on the applicator pad.

3 Claims, 9 Drawing Sheets

DETACHABLE FLUID TREATMENT APPLICATOR

CROSS REFERENCE TO RELATED APPLICATION

This application claims the benefit of the prior filed, provisional application, Ser. No. 60/433,639, filed Dec. 16, 2002.

FIELD OF THE INVENTION

This invention relates to the field of applicators for applying fluid treatments such as paint, stain, varnish and the like and particularly to applicators including elongated handles and detachable applicator pads.

BACKGROUND OF THE INVENTION

Various devices are provided in the prior art for applying paint, stain, varnish and similar fluid treatments. Application of such treatments is typically accomplished by either spraying a surface with droplets of the fluid or by transferring the fluid from an applicator such as a brush or roller. While spraying can cover large areas in a short amount of time, it can be extremely wasteful. Large amounts of the treatment fluid may be carried away by wind or deposited on areas not intended for treatment. Application by brush or roller is more directed to the intended treatment area but can be difficult when the user is presented with complex surfaces.

BRIEF SUMMARY OF THE INVENTION

A device for applying treatment fluid such as paint, stain, varnish or the like including an elongated handle having an applicator pad attached to one end. The pad is typically dipped into a container of treatment fluid to load the pad. Excess fluid may be removed from the pad by pressing it against the inside wall of the container. The elongated handle is then gripped by the user while the pad is drawn over surfaces to be treated. Due to the elongated handle, application may be performed while minimizing the need for the user to bend and kneel. In addition, the user's reach is generally increased relative to an ordinary brush or roller.

The portion of the device bearing the applicator pad may be dislocated or detached from the rest of the handle by breaking the handle along a line or zone of fracture. The zone of fracture typically comprises a scored or perforated notch cut transversely across the handle near the applicator pad. A knob is provided for attachment at the applicator pad after the pad is detached from the handle. The knob provides a means for the user to grip the applicator pad during application of treatment fluid. Prior to detaching the applicator pad from the handle, the device is particularly well-adapted to application of treatment fluid such as paint, stain, varnish or the like to narrow vertical surfaces such as railing spindles or to surfaces that would otherwise be out of reach. The detached applicator pad is particularly well-adapted to application of treatment fluid to the tops of handrails or broad horizontal surfaces.

DETAILED DESCRIPTION

Figure 2:
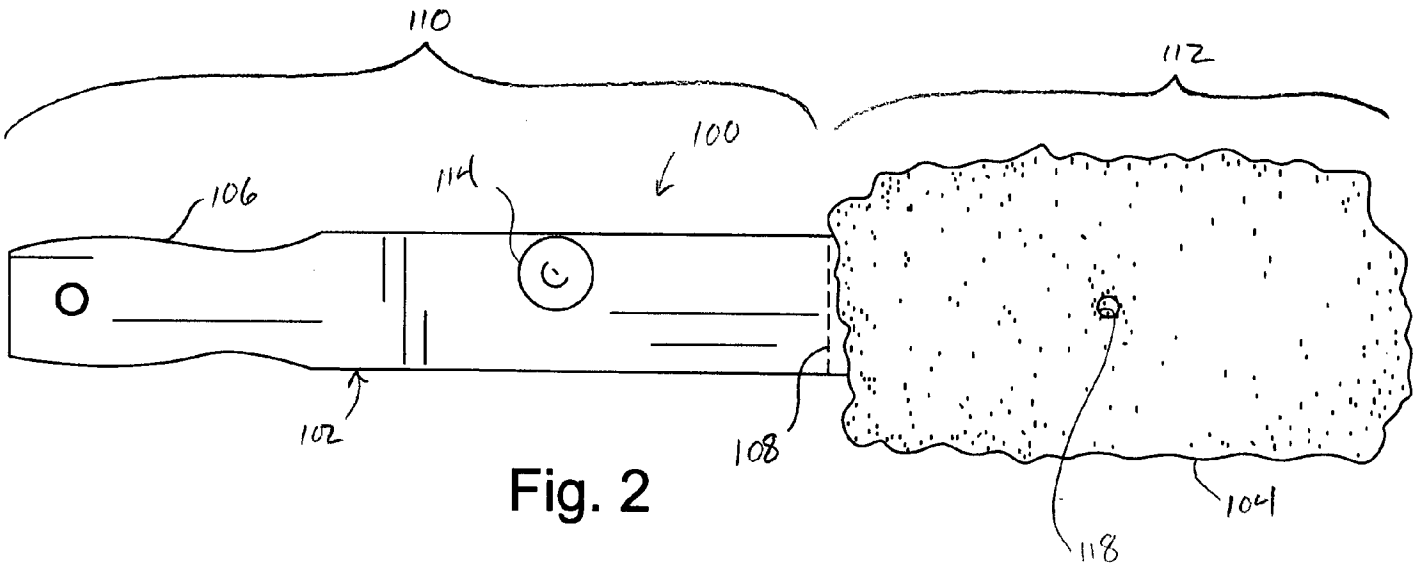
FIG. 2 is a plan view of the applicator of FIG. 1.
Figure 3:
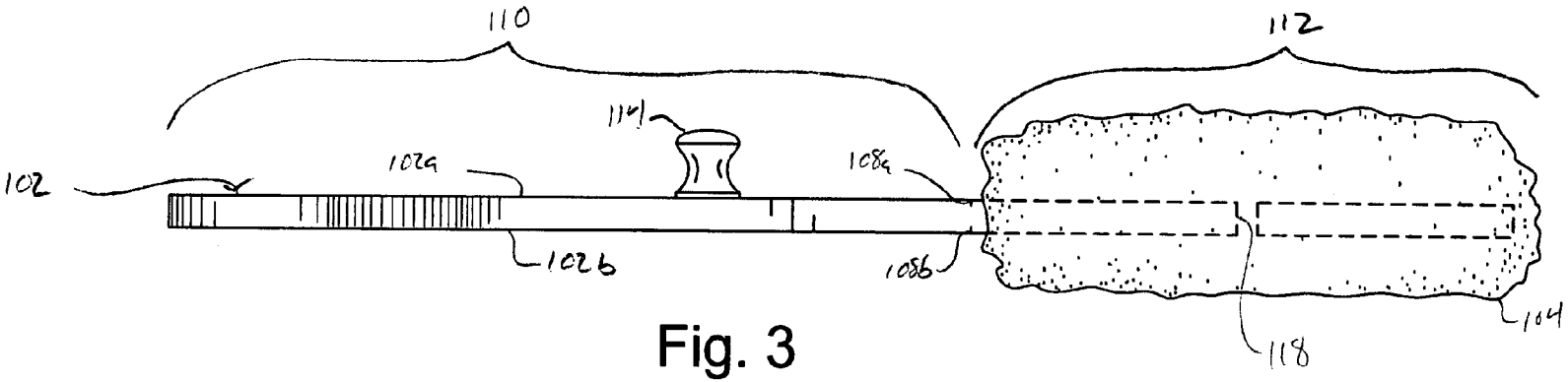
FIG. 3 is a side elevational view of the applicator.
Figure 4:
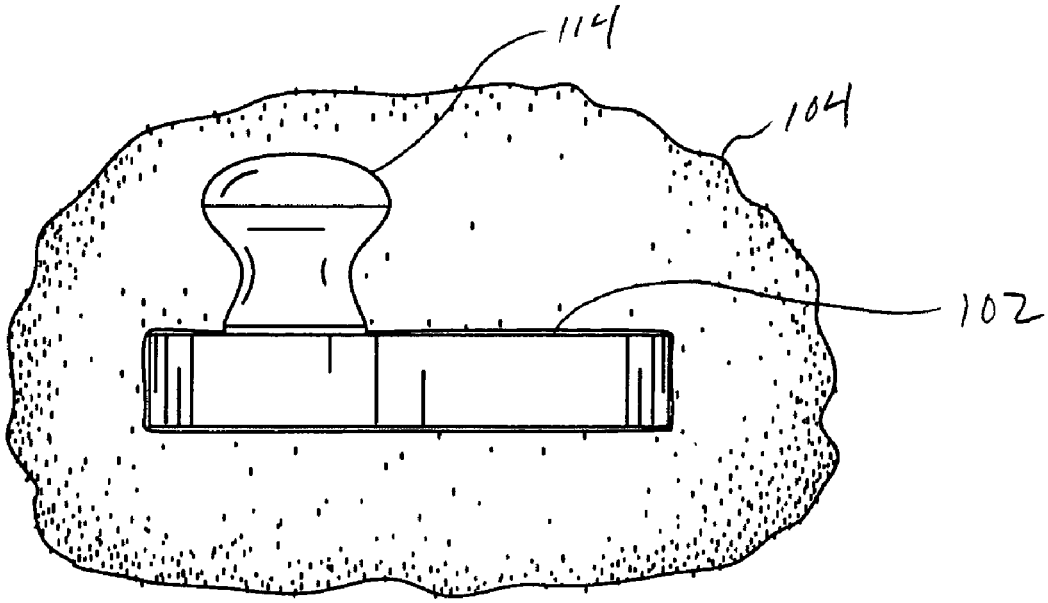
FIG. 4 is a rear end view of the applicator.
Figure 5:
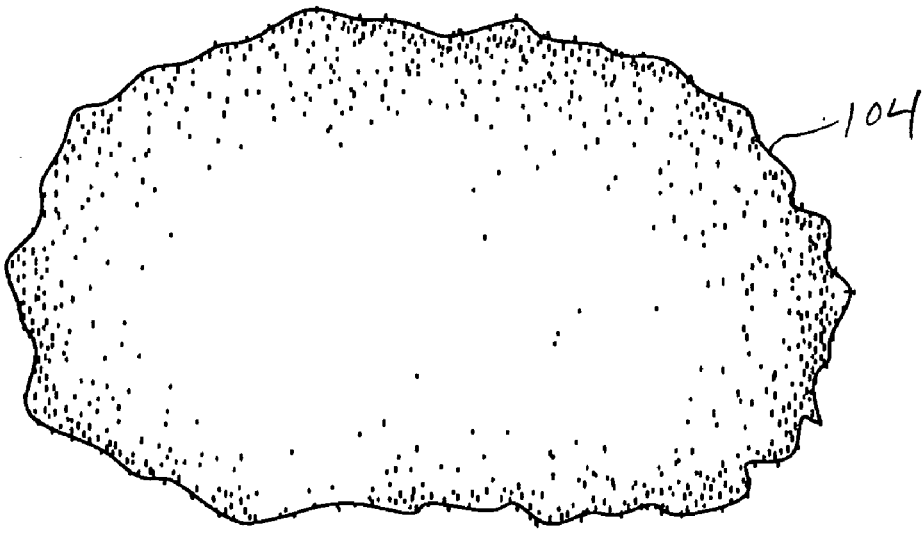
FIG. 5 is a front end view of the applicator.

Referring now to the drawings, and initially in particular to FIGS. 1–5, wherein like reference numerals indicate like parts throughout the several views, an applicator device 100 for applying fluid such as paint, stain, varnish or the like is illustrated and includes an elongated handle 102 having an applicator pad 104 on the proximate end of the handle 102. The distal or opposing end of the handle 102 forms or includes a primary grip or gripping element 106. The applicator pad 104 is formed of fluid-retaining material for transferring fluid from the device 100 to a surface to be treated. Appropriate fluid-retaining material includes sheep or lamb wool with leather backing, synthetic material such as foam rubber, and/or fabric. FIG. 4 illustrates the applicator 100 of FIG. 1 as viewed in elevation from the distal end. FIG. 5 illustrates the applicator 100 of FIG. 1 as viewed in elevation from the proximate end. The applicator pad material may be attached to the handle 102 using staples (not shown) or other appropriate means.

Figure 6:
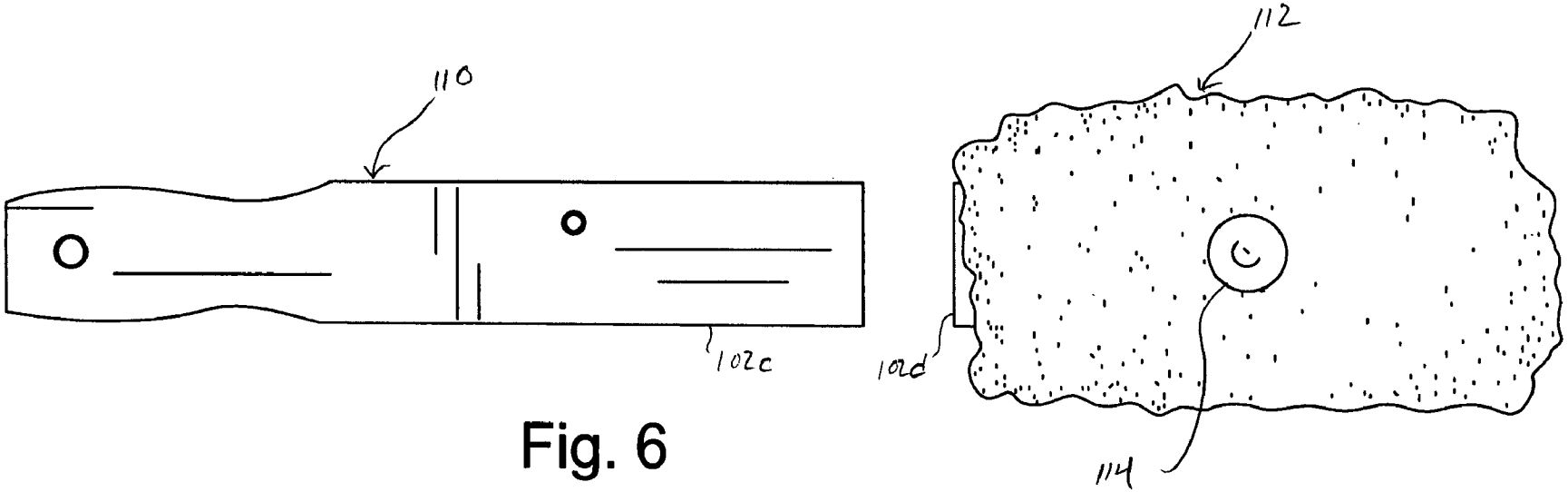
FIG. 6 is a plan view of the applicator of FIG. 1 showing the applicator portion detached from the gripping portion of the handle and the knob transferred from the gripping portion of the handle to the applicator portion.
Figure 7:
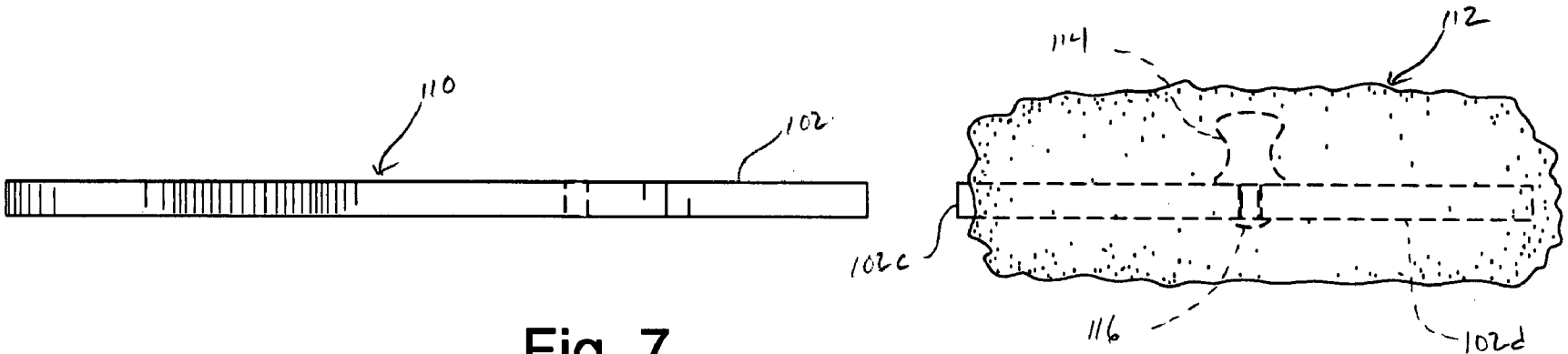
FIG. 7 is a side elevational view of the applicator of FIG. 6 with the portion of the handle inside the applicator pad, as well as the knob, drawn in phantom lines.
Figure 14:
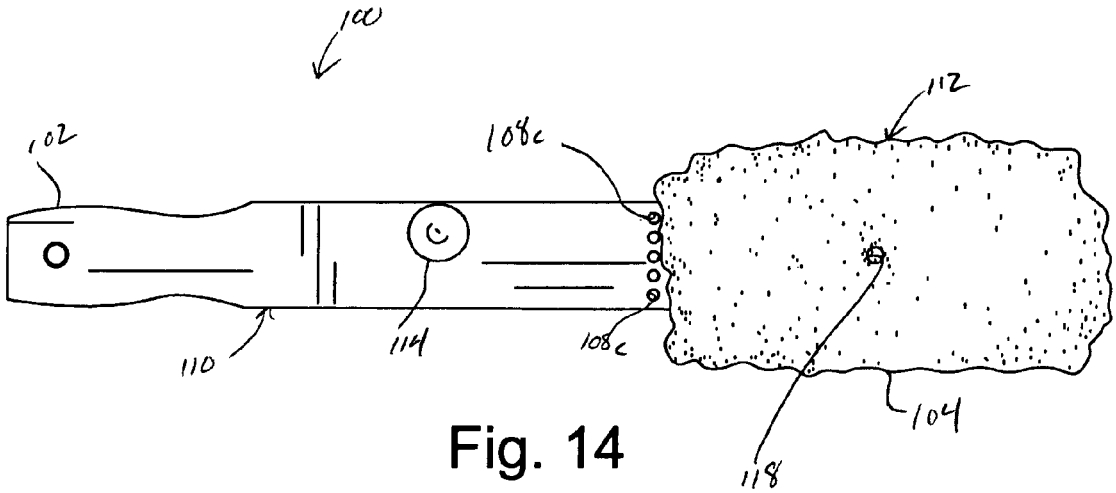
FIG. 14 is a plan view of the applicator illustrating a fracture zone defined by a series of perforations, detents or holes in the handle.
Figure 15:
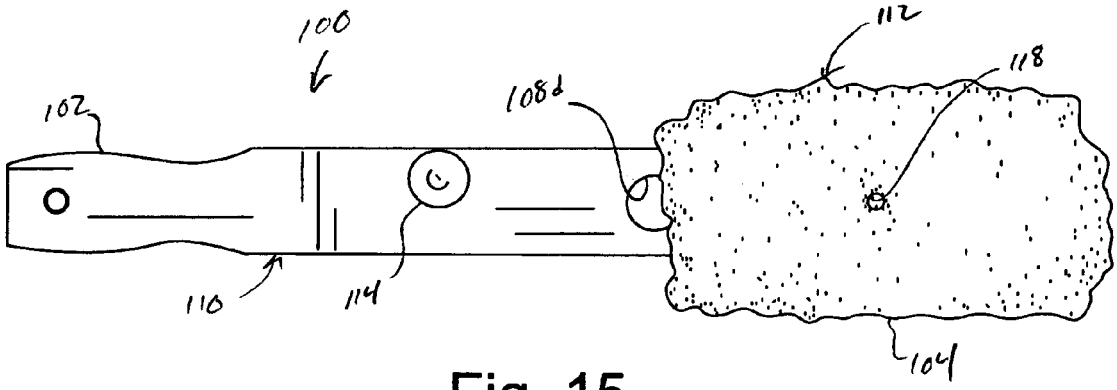
FIG. 15 is a plan view of the applicator illustrating a fracture zone defined by a single hole in the handle.

The handle 102 may be formed from a paint stick or paddle and may comprise wood or plastic. The handle 102 includes a substantially transverse zone of fracture 108 (see FIG. 2) which defines the boundary between the primary gripping portion 110 of the device 100 and the detachable applicator portion 112. As illustrated, this fracture zone 108 comprises transverse scores or notches 108*a* and 108*b* on the top 102*a* and bottom 102*b* surfaces of the handle (see FIG. 3). A fracture zone 108 may also be created through use of perforations, detents or one or more holes (see 108*c* and 108*d*, FIGS. 14 and 15). The handle 102 may be broken at the fracture zone 108 to detach the applicator portion 112 from the primary gripping portion 110. FIGS. 6 and 7 show the handle 102 broken into piece 102*c*, associated with the primary gripping portion 110 of the device 100, and piece 102*d*, associated with the applicator portion 112 of the device 100.

Figure 10:
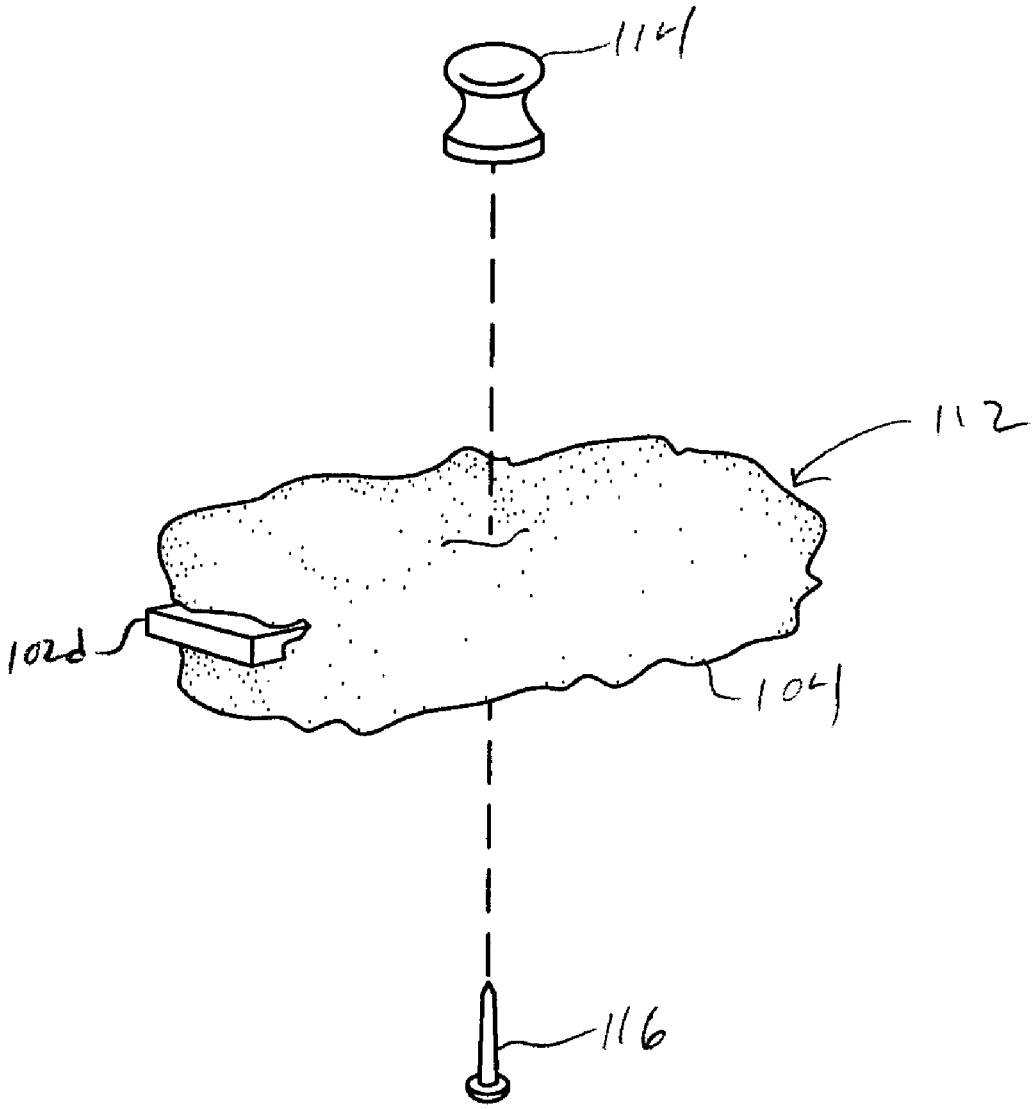
FIG. 10 is a partial exploded view of the knob, applicator portion, and screw.

A secondary grip or gripping element 114 is provided for attachment to the applicator portion 112. As illustrated, the secondary grip 114 may comprise a rounded wooden knob 114. The knob 114 may be attached to the applicator portion 112 by passing a screw 116 or other suitable attachment device through a hole 118 in the applicator portion 112 and then into the underside of the knob 114. FIG. 10 illustrates in exploded view the engagement of the knob 114 and screw 116 with the applicator portion 112, including a remaining length of handle 102*d* protruding from the applicator pad 104.

Figure 1:
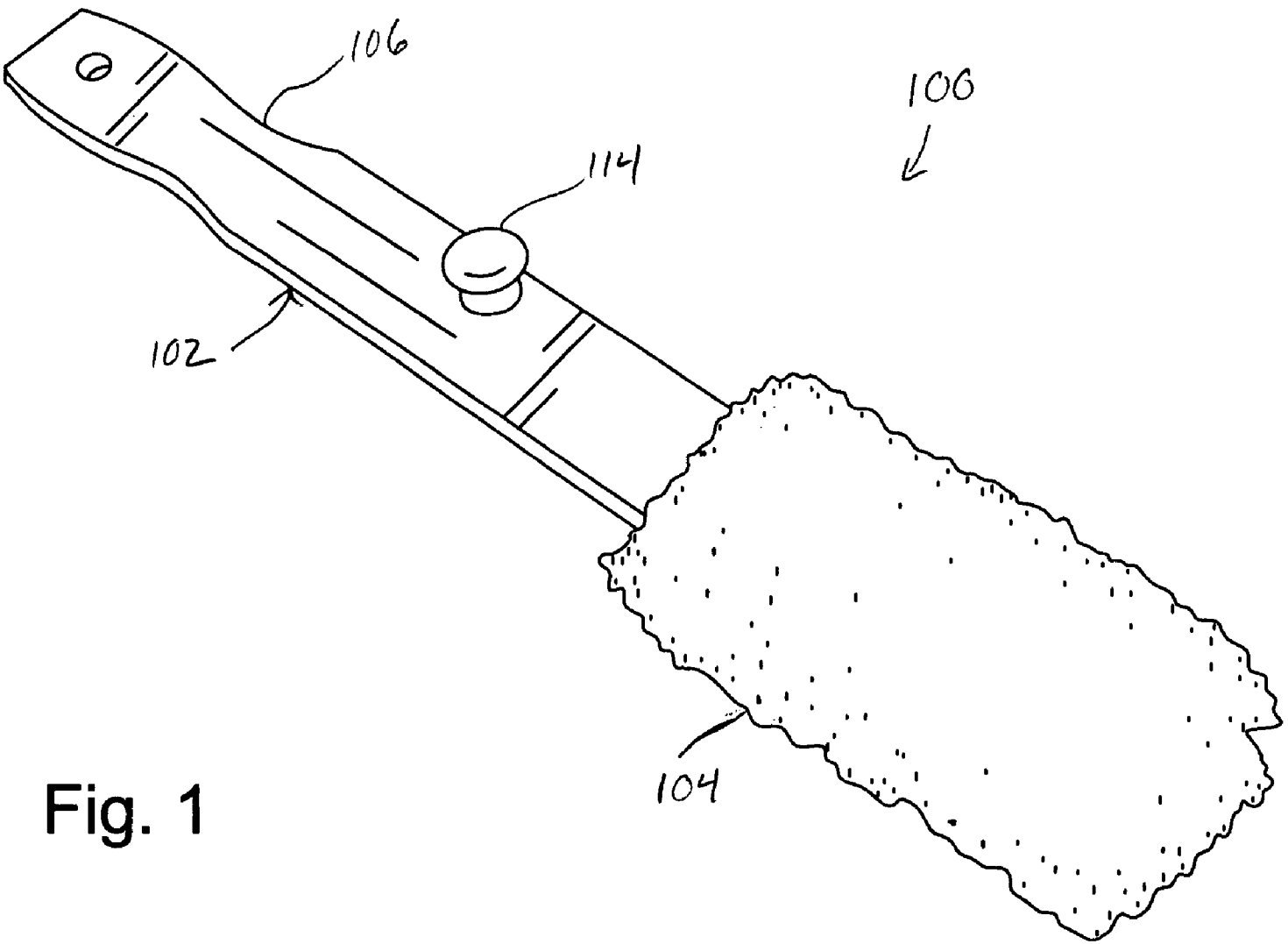
FIG. 1 is a frontal and side perspective view of a fluid treatment applicator in accordance with an embodiment of the present invention.

As shown in FIGS. 1 through 3, the knob 114 may be retained on the handle 102 until required after detachment of the applicator portion 112 from the primary gripping portion 110. FIGS. 6 and 7 show a top plan view and side elevational view, respectively, of the device 100 with the applicator portion 112 detached from the primary gripping portion 110, and the knob 114 transferred from storage on the primary gripping portion 110 to engagement with the applicator portion 112.

Figure 8:
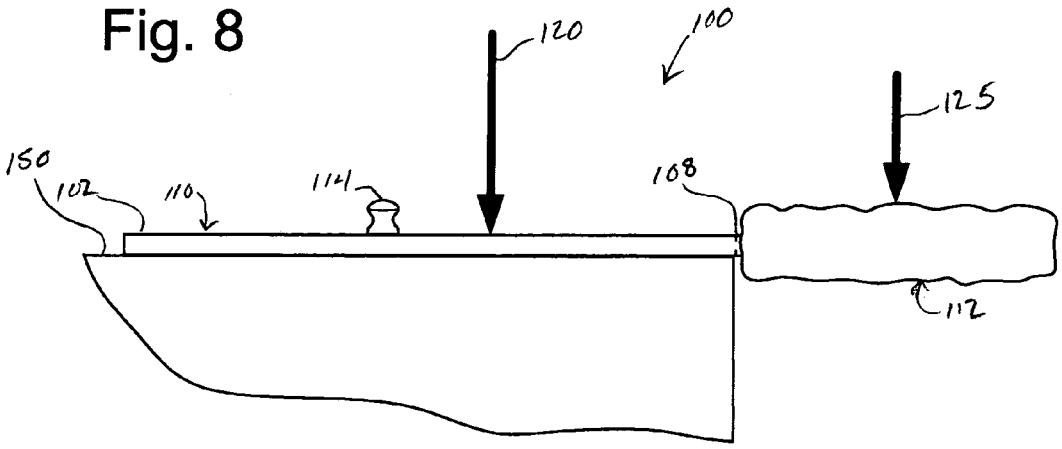
FIG. 8 is a diagram showing an applicator positioned for breakage along the fracture zone of the handle.
Figure 9:
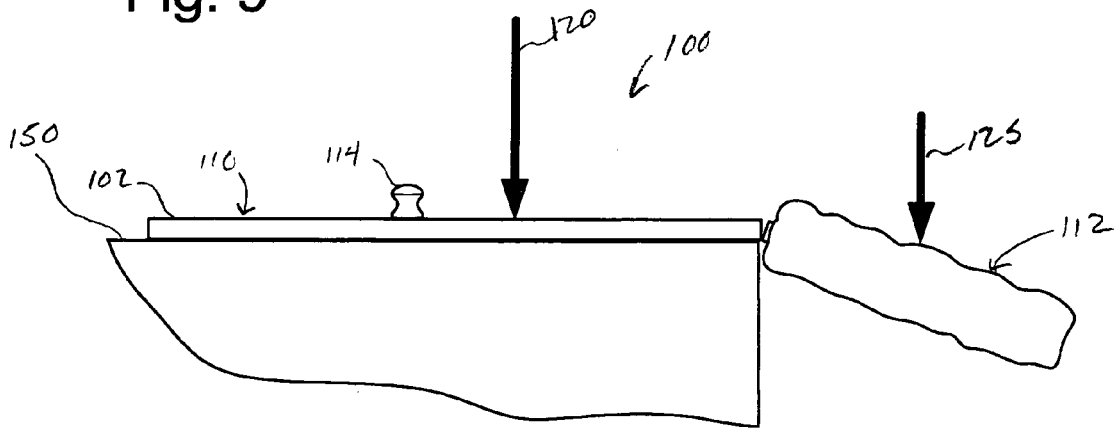
FIG. 9 is a diagram showing the applicator of FIG. 8, with the applicator portion separated from the gripping portion by breakage along the fracture zone of the handle.

FIGS. 8 and 9 are diagrams illustrating the separation or detachment of the application portion 112 from the primary gripping portion 110. In FIG. 8, the device 100 has been laid upon a stable horizontal surface such as a deck rail 150 such that the fracture zone 108 lies across the comer edge of the rail 150. Force (as indicated by arrow 120) is applied to the primary gripping portion 110 to hold the device 100 in place. Additional force (as indicated by arrow 125) is applied to the applicator portion 112. Upon application of sufficient force 125 the handle 102 is broken proximate to the fracture zone 108 thereby separating the applicator portion 112 from the primary gripping portion 110.

Figure 11:
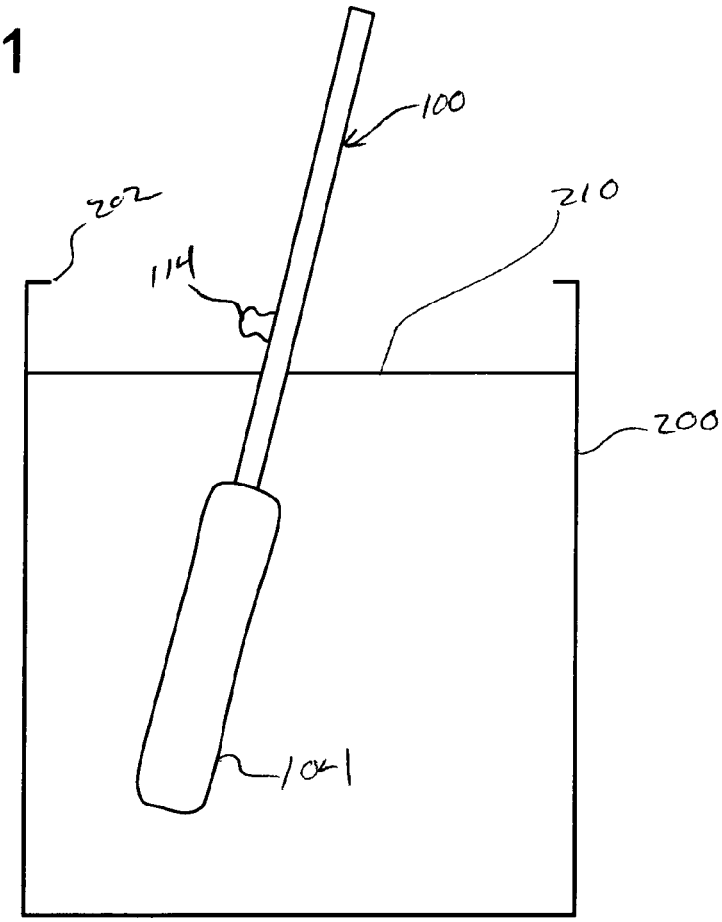
FIG. 11 is a side view diagram showing insertion of the applicator into a typical container of treatment fluid.
Figure 12:
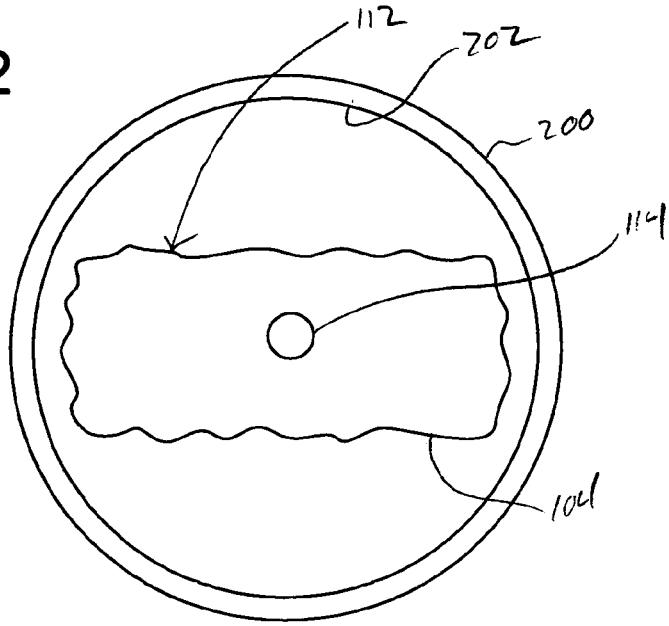
FIG. 12 is a top view diagram indicating preferred clearance of the applicator portion from the sides of the opening of the fluid container.

FIG. 11 is a side view sectional diagram showing insertion of the device 100 into a typical container of treatment fluid such as a paint can 200. Preferably the fluid level 210 in the container 200 is maintained so as to allow complete immersion of the applicator pad 104. FIG. 12 is a top view diagram indicating preferred minimal clearance of the detached applicator portion 112 from the interior sides 202 of the opening of the fluid container 200.

Figure 13:
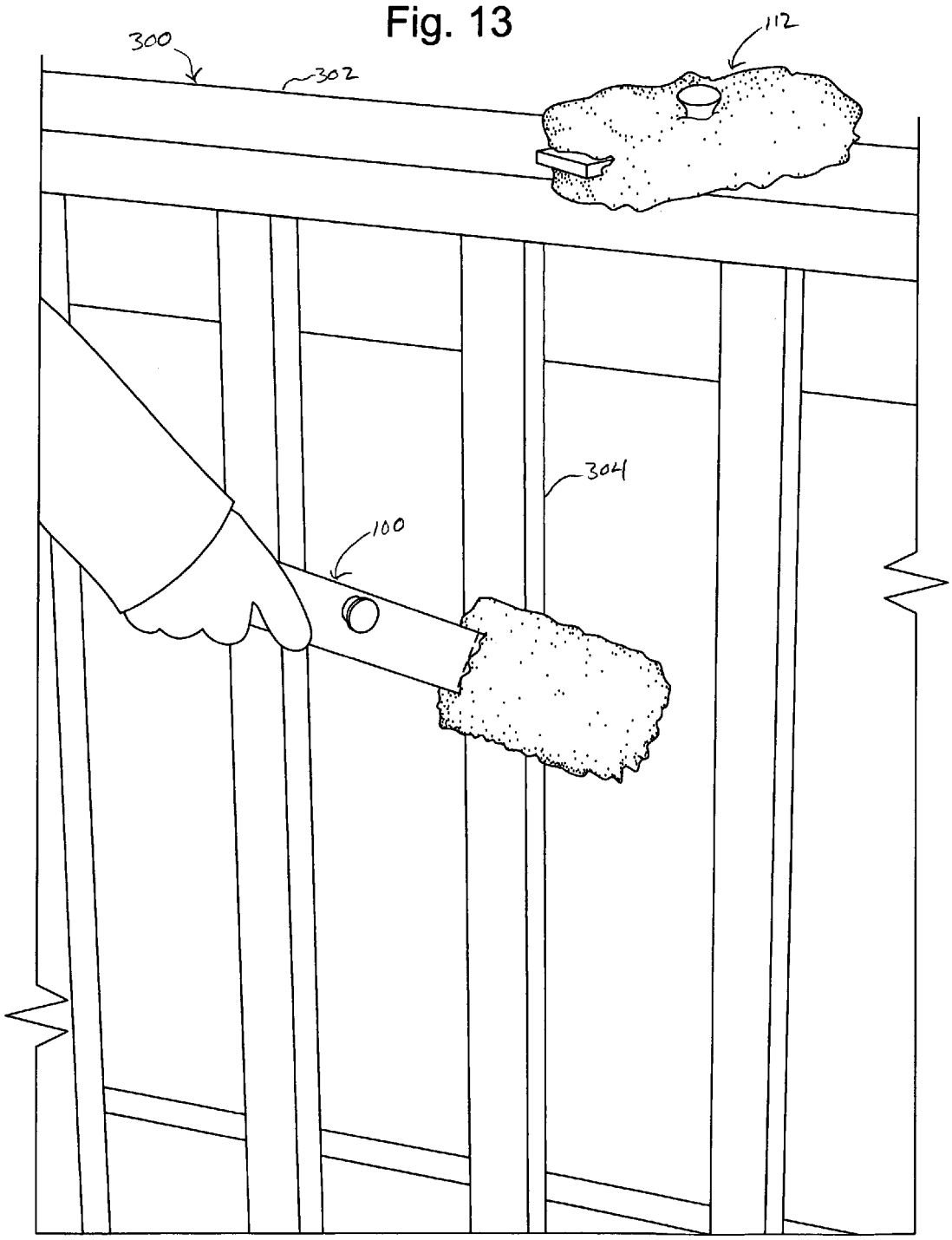
FIG. 13 is an environmental view of the applicator being used to apply treatment fluid to a spindle of a deck railing, as well as a view of a detached applicator portion resting upon a horizontal handrail of a deck railing.

FIG. 13 is an environmental view of the device 100 being used to apply treatment fluid such as stain to a spindle 304 of a deck railing 300, as well as a view of a detached applicator portion 112 resting upon a horizontal handrail portion 302 of a deck railing 300.

A surface may be treated with a fluid such as paint, stain, varnish or the like using a device 100 presenting an embodiment of the invention by providing an elongated handle 102 having an applicator pad 104 attached to the applicator portion 112 of the handle, the opposing end of the handle serving as a primary gripping element 110. The applicator pad 104 is may then be loaded with selected treatment fluid and the fluid transferred from the applicator pad 104 to a selected surface such as a vertical spindle 304 by wiping the applicator pad 104 across the surface. When it is desired to use only the applicator portion 112, the handle 102 may be broken along a substantially transverse zone of fracture 108 located between the primary gripping portion 110 and the applicator pad 104 to detach the applicator pad 104 from the primary gripping portion 110. A secondary gripping element such as knob 114 may then be detached from the primary gripping portion 110 and attached to the applicator portion 112. Fluid may then be transferred from the applicator pad 104 to the selected surface by wiping the applicator pad 104 across the surface.

It is to be understood that while certain forms of this invention have been illustrated and described, it is not limited thereto except insofar as such limitations are included in the following claims and allowable equivalents thereof.

Having thus described the invention, what is claimed as new and desired to be secured by Letters Patent is as follows:

1. A device for applying fluid such as paint, stain, varnish or the like, comprising:

an elongated handle having an applicator portion on one end of said handle and a primary gripping portion on the opposite end of said handle, said applicator portion including a covering of fluid-retaining material for transferring such fluid from said applicator portion to a surface, said handle including a substantially transverse zone of fracture defining a boundary between said primary gripping portion and said applicator portion, whereby said handle may be broken along said zone of fracture thereby separating said applicator portion from said primary gripping portion, and a secondary gripping element detachable from said primary gripping element and attachable to said applicator portion.

2. A disposable device for applying fluid such as paint, stain, varnish or the like comprising:

an elongated paddle element having an applicator portion at one end, said applicator portion substantially covered with fluid retaining material, a primary gripping portion comprising a portion of said paddle element projecting from said applicator portion, one or more detents in the surface of said paddle element, said detents located between said applicator portion and said primary gripping portion so that upon application of sufficient force said paddle element may be broken proximate to said detents thereby separating said applicator portion from said primary gripping portion, and a secondary gripping element attachable to said applicator portion.

3. The device of claim 2, wherein said secondary gripping element is stored upon said primary gripping portion for attachment proximate to said fluid-retaining material after detachment of said applicator portion from said primary gripping portion.

* * * * *